US012305851B2

(12) United States Patent
Felix et al.

(10) Patent No.: US 12,305,851 B2
(45) Date of Patent: May 20, 2025

(54) BURNER SUPPLY TUBE WITH FUEL CHANNEL

(71) Applicant: Siemens Energy Global GmbH & Co. KG, Bayern (DE)

(72) Inventors: Lennart Felix, Finspang (SE); Anders Haevaker, Linkoping (SE); Olle Lindman, Finspang (SE); Jan-Erik Lundgren, Svärtinge (SE); Simon Svanström, Norrköping (SE); Marcus Oscarsson, Norrköping (SE)

(73) Assignee: Siemens Energy Global GmbH & Co. KG, Bayern (DE)

( * ) Notice: Subject to any disclaimer, the term of this patent is extended or adjusted under 35 U.S.C. 154(b) by 171 days.

(21) Appl. No.: 18/032,179

(22) PCT Filed: Aug. 11, 2021

(86) PCT No.: PCT/EP2021/072330
§ 371 (c)(1),
(2) Date: Apr. 16, 2023

(87) PCT Pub. No.: WO2022/089804
PCT Pub. Date: May 5, 2022

(65) Prior Publication Data

US 2023/0392783 A1 Dec. 7, 2023

(30) Foreign Application Priority Data

Oct. 29, 2020 (EP) ..... 20204639

(51) Int. Cl.
*F23C 1/08* (2006.01)
*F23D 11/38* (2006.01)
(Continued)

(52) U.S. Cl.
CPC ..... *F23C 1/08* (2013.01); *F23D 11/383* (2013.01); *F23D 14/24* (2013.01); *F23R 3/36* (2013.01); *F23R 2900/00001* (2013.01)

(58) Field of Classification Search
CPC ..... F23C 1/08; F23D 11/383; F23D 14/22; F23D 14/24; F23D 14/48; F23D 2204/10;
(Continued)

(56) References Cited

U.S. PATENT DOCUMENTS

2011/0289842 A1 12/2011 Oldenburg
2016/0186663 A1* 6/2016 Stewart ..... F23R 3/286 60/737

(Continued)

FOREIGN PATENT DOCUMENTS

CN 204841739 U 12/2015
FR 2532043 A1 2/1984

OTHER PUBLICATIONS

Database WPI, 0, Derwent World Patents Index, vol. 2016, No. 01, Database accession No. 2015-82439M, XP002802639 & CN204841739U U 20151209 (Shandong Huayi Detection Co Ltd) [X] 1-6; Abstract.

*Primary Examiner* — Scott J Walthour
(74) *Attorney, Agent, or Firm* — Wolter Van Dyke Davis, PLLC

(57) ABSTRACT

A burner supply tube, and a burner arrangement having such a burner supply tube, which includes a tube wall extending having a tube diameter and at least one integrated fuel channel extending from a fuel input at an upstream tube end to a fuel output at a downstream tube end. To enable an integrated design, the fuel channel is along the majority of the tube length helical with a gradient of at least 0.5 times and at most 5 times the tube diameter.

23 Claims, 3 Drawing Sheets

(51) Int. Cl.
*F23D 14/24* (2006.01)
*F23R 3/36* (2006.01)

(58) Field of Classification Search
CPC ..... F23D 2206/10; F23R 3/283; F23R 3/36; F23R 2900/00001
See application file for complete search history.

(56) References Cited

U.S. PATENT DOCUMENTS

| | | | | |
|---|---|---|---|---|
| 2016/0290291 | A1* | 10/2016 | Prociw | F23R 3/283 |
| 2016/0290649 | A1* | 10/2016 | Prociw | F23R 3/14 |
| 2017/0108223 | A1* | 4/2017 | Ryon | F23R 3/12 |
| 2019/0186749 | A1 | 6/2019 | Harper | |

* cited by examiner

BURNER SUPPLY TUBE WITH FUEL CHANNEL

CROSS REFERENCE TO RELATED APPLICATIONS

This application is the US National Stage of International Application No. PCT/EP2021/072330 filed 11 Aug. 2021, and claims the benefit thereof. The International Application claims the benefit of European Application No. EP20204639 filed 29 Oct. 2020. All of the applications are incorporated by reference herein in their entirety.

FIELD OF INVENTION

The invention is about a burner supply tube a part of a burner arrangement, wherein a fluid could be guided within the burner supply tube to a burner. To enable a further supply with a fuel the burner supply tube comprises additionally an integrated fuel channel.

BACKGROUND OF INVENTION

A common burner arrangement for a usage within a combustion section of a gas turbine comprises at first at least on burner. The burner itself is arranged on the upstream side of a combustion chamber, wherein a fuel is burned with combustion air. The burners—in regard to the invention—are able to operate with two different kinds of fuels. Therefore, it is necessary to provide the burner arrangement with two different fuel supplies. A known solution comprises three coaxially tubes arranged upstream of the burner. Through the center a first fuel—a regular gaseous fuel—and through an annular channel between the center tube and the middle tube the combustion air could be supplied to the burner. The outer tube is usually used as protection for the upstream side of the burner arrangement. As a second fuel in frequent cases a liquid fuel is used. Therefore, the cross section to supply the liquid fuel could be significantly lower than the cross section necessary to supply the gaseous fuel. As result the common solution comprises a fuel pipe arranged parallel to the arrangement of tubes to guide the liquid fuel to the burner.

Even though the usage of a fuel pipe is a common and easy solution, there are some problems remaining, as the thermal displacement and further the sealing of the burner arrangement needs to be considered. Therefore, further solutions try to integrate the fuel channel into one of the tubes as straight-line bore inside the wall of the tube. To prevent an increase of the thickness of the respective tube, generally several bores with a smaller diameter are used to replace a single pipe arranged outside of the tubes.

SUMMARY OF INVENTION

The task for the invention is the design of an improved solution to supply the burner with a liquid fuel parallel to an arrangement of coaxially tubes for a gaseous fuel and for combustion air.

The task is solved by a burner supply tube and a burner arrangement having such a burner supply tube according to the claims. Further advantageous solutions are subject of the dependent claims.

The generic burner supply tube comprises at first a tube wall extending from an upstream tube end to a downstream tube end and has a substantially cylindrical shape.

Thereby the burner supply tube defines a tube length from the upstream tube end to the downstream tube end and further a tube diameter as the dimension of the outer side of the tube wall. Here, the tube length is at least 2 times and at most 20 times the tube diameter. Further, the burner supply tube is a hollow part with a substantially thin tube wall, wherein the tube wall has a wall thickness, which is at least 0.01 times and at most 0.2 times the tube diameter.

To enable the supply of a liquid fuel along the burner supply tube, the burner supply tube further comprises at least one integrated fuel channel extending along the tube wall. Necessarily the fuel channel starts at a fuel input and leads to a fuel output. Here, the fuel input is not necessarily located directly at the upstream tube end but needs to be arranged at least in the edge area near the upstream tube end. Analogous the fuel output is arranged at the downstream tube end within the edge area of the downstream tube end or immediately at the downstream tube end.

It must be noted that the burner supply tube does not necessarily have a free upstream tube end and/or a free downstream tube end. As part of a burner arrangement further components would be rather arranged at the upstream tube end and/or at the downstream tube end of the burner supply tube. To determine the burner supply tube with the upstream tube end and the downstream tube end in the sense of this invention the tube wall and the fuel input and the fuel output needs to be considered. If the upstream tube end or the downstream tube end could not be determined obviously by the shape of the tube wall comprising the fuel input close to the upstream tube end respectively the fuel output close to the downstream tube end, the upstream tube end is 0.25 times the tube diameter upstream the fuel input and analogous the downstream tube end is 0.25 times the tube diameter downstream the fuel output.

It should be possible to supply fuel, in particular a liquid fuel, through the fuel channel to the burner. Therefore, an equivalent diameter of the fuel channel should not be less than 0.3 times the wall thickness of the tube wall.

Obviously, if the fuel channel has a circular shape, the diameter of the circular shape is the equivalent diameter of the fuel channel. Otherwise, the equivalent diameter could be calculated by the determination of the cross section of the fuel channel.

To arrange the fuel channel integrated into the burner supply tube the size of the fuel channel should not exceed a certain limit. (Obviously in the state of the art with integrated fuel channels inside the tube wall the diameter of the fuel channels must be less than the thickness of the tube wall.) Here, to enable the arrangement of the fuel channel at the burner supply tube the equivalent diameter of the fuel channel should not exceed 3 times the wall thickness of the tube wall.

To enable the increase of the diameter of the fuel channel and to prohibit an uncontrollable deformation of the burner supply tube by a thermal displacement the fuel channel is now designed in the form of a helix. It is not necessary, that the fuel channel comprises the helical shape from the fuel input to the fuel output, but at least along the majority of the tube length the fuel channel needs to have a helical design with a gradient of at least 0.5 times and at most 5 times the tube diameter.

To guarantee a sufficient stability of the burner supply tube at the position of the fuel channel it is advantageous to increase the thickness of the tube wall in that certain area. Therefore, a local thickening on the outer side of the tube wall and/or on the inner side of the tube wall at the position of the fuel channel is advantageous.

At first benefit the size of the fuel channel could be increased as a thickening at the outer side and/or at the inner side of the burner supply tube due to the fuel channel could be allowed. Even with the thickening a thermal stress on the component, does—due to the helical shape—not lead to an undetermined deformation or an unallowable thermal stress inside the tube wall. Regular this is a major problem if the fuel channel with a bigger size is in a straight line along the tube wall and different thermal expansion occur within the tube wall at the fuel channel and beside the fuel channel. Next, a thickening at the tube wall due to the fuel channel could influence the fluid stream inside and/or outside the burner supply tube in a positive way, as a swirl could be added to the fluid stream.

But on the other hand, the thickness should not be more than necessary. Thereby the local thickness of the burner supply tube at the fuel channel is advantageously at most 3 times the equivalent diameter of the fuel channel.

Analogous the local thickness of the burner supply tube at the fuel channel is advantageously at most 3 times the wall thickness of the tube wall.

The most benefit could be archived by the inventive solution if the burner supply tube comprises certain relative dimensions. Therefore, it is advantageous if the tube length is at least 4 times and/or at most 10 times the tube diameter. It is also advantageous if the wall thickness is at least 0.02 times and/or at most 0.1 times the tube diameter. As result the tube wall has the shape of a tube in a common sense.

To arrange the fuel channel with the helical shape at the tube wall and to make use of an optimized size of the fuel channel it is in particular advantageous to arrange only one fuel channel or just two fuel channels arranged opposite to each other at the burner supply tube. It could still be advantageous to make use of three fuel channels arranged offset in circumference direction. But with each additional channel the benefit of the inventive solution decreases with an approach to common solutions.

Next with the burner supply tube a beneficial supply of a liquid fuel could be archived, it the fuel channel has advantageously an equivalent diameter of at least 0.6 times the wall thickness. These leads—not necessarily but usually—to a thickening on the outer side and/or on the inner side of the tube wall. As explained before, the thickening with the helical shape does not hinder the usability of the solution, but the increase of the size of the fuel channel the supply of a liquid fuel through a single (each of or the one) fuel channel could be improved.

On the other hand, the size of the fuel channel should not be oversized compared to the thickness of the tube wall. Here, it is advantageous if the equivalent diameter is at most 1.5 times the wall thickness.

To prevent unallowable thermal stress inside the burner supply tube and to prevent uncontrollable thermal deformation it is further advantageous if the helical section of the fuel channel has a certain shape in regard to the size of the burner supply tube. Here, it is advantageous if the gradient of the fuel channel is at least 1 time and/or at most 2.5 times the tube diameter. Within this range the best results with respect to thermal stress could be achieved.

Obviously, it makes less sense to arrange the fuel input or the fuel output at the inner side of the tube wall as the connection the next component upstream (fuel input) or downstream (fuel output) is more difficult. As result an arrangement of the fuel input at the upstream tube end with an opening to the upstream side and also an arrangement of the fuel output at the downstream tube end with an opening to the downstream side is possible. But it is preferred to arrange the fuel input and/or the fuel output on the outer side of the tube wall of the burner supply tube. This could simplify the connection to the fuel input respectively to the fuel output if the attached component embraces the upstream tube end respectively the downstream tube end of the burner supply tube.

The fuel channel is an integrated feature of the burner supply tube and therefore needs to be arranged at or within the tube wall. Even it is possible to arrange the fuel channel at the outer side or at the inner side of the tube wall it is advantageous, if at least the center of the fuel channel is arranged within the outer side and the inner side of the tube wall (without the fuel channel). It is in particular advantageous if the center of the fuel channel is arranged between the middle and the inner side of the tube wall.

The inventive burner supply tube enables the design of a new inventive burner arrangement, which is intentionally used in a combustion section. In principle it is possible to use the burner arrangement at different kinds of combustion system, but it is advantageous to use the solution at a combustion section of a gas turbine. The burner arrangement comprises at first a burner, which is intentionally arranged upstream of a combustion chamber of the combustion section. To supply the burner with different kind of fuel and combustion air the generic solution comprises a tube arrangement arranged upstream of the burner. This tube arrangement comprises an outer protection tube at the outer side of the tube arrangement. Next inside the outer protection tube a burner supply tube is necessary. Within the burner supply tube, a first inner fluid supply tube is arranged. As result an outer annular space is arranged between the outer protection tube and the burner supply tube. On the inner side of the burner supply tube between this and the first inner supply tube a second annular space is available.

In a further advantageous solution, the tube arrangement comprises a further second inner fluid supply tube arranged inside the first inner fluid supply tube creating a further annular space between both the inner fluid supply tubes.

Which of the annular spaces is used to guide a fuel, in particular a gaseous fuel, and which is used to guide the combustion air is not relevant here.

An improved possibility to supply the burner with a liquid fuel is enabled with the inventive burner arrangement, which makes use of the inventive burner supply tube and enables a beneficial guidance of a liquid fuel through the fuel channel within the burner supply tube from the upstream side of the tube arrangement to the burner at the downstream side of the tube arrangement.

At first it is not relevant how the tube arrangement and the burner is connected. A first possibility is to fit the downstream tube end of one or more of the tubes in respective sleeves of the burner. To guarantee a safe guidance of fuel and combustion air to the burner separate from each other and to enable a fixed position of the tube arrangement relative to the burner it is advantageous if the outer protection tube is firmly connected with the burner.

Here, it is possible to mount the outer protection tube at the burner. A further option is a solution, where both parts are welded or brazed to each other. As a third option is an integral solution.

Also, the burner supply tube could be arranged movable within a sleeve of the burner. But analogous it is advantageous to connect the burner supply tube with the burner in a firm manner. The same applies for the first fluid supply tube and if existing also for the second fluid supply tube. It is in particular advantageous if all tubes of the tube arrangement are connected firmly with the burner.

To enable the fitting of further pipes and channels to the tube arrangement the burner arrangement comprises advantageously a terminal block. This terminal block is arranged upstream of the tube arrangement and enables on the upstream side the attachment of other means.

To achieve a fluid tight connection and a defined position of the terminal block relative to the tube arrangement advantageously the terminal block is firmly connected to the burner supply tube. Analog, a mounted or a welded or an integral solution is possible.

It is further advantageous, if the outer protection tube is also firmly connected to the terminal block. To avoid unallowable thermal stress due to different thermal expansion of the burner supply tube and the outer protection tube it is in particular advantageous, if the outer protection tube comprises some bellows.

A fluid tight connection between one of the inner tubes with the terminal block is requested, but less important than at the outer tube. To avoid thermal stress at the first fluid supply tube and/or the second fluid supply tube preferably a connection between the first fluid supply tube and the terminal block respectively between the second fluid supply tube and the terminal block is provided, which enables a relative thermal expansion, for example by fitting the upstream tube end of the fluid supply tube within a sleeve.

The arrangement of the first fluid supply tube within the burner supply tube leads to an annular free space, which is used advantageously as an annular fluid channel to guide a—in particular gaseous—fuel or combustion gas to the burner. Therefore, it is advantageous if the width—the distance between the inner side of the burner supply tube and the outer side of the first fluid supply tube—of the annular fluid channel is at least 0.05 times the tube diameter. The advantage usage of the first supply tube to guide further medium, e.g. a gaseous fuel or combustion gas, inside the first supply tube could be achieved, if the width of the annular fluid channel is preferred not more than 0.3 times the tube diameter. Here, it is particularly advantageous if the width of the annular fluid channel is at least 0.1 times the tube diameter and/or at most 0.2 times the tube diameter.

If a thickening on the inner side of the burner supply tube is given, obviously the distance to the first fluid supply tube is decreased locally at the position of the fluid channel. As the fluid channel comprises a helical shape, the thickening could have a beneficial effect on the fluid stream inside the annular fluid channel. Therefore, it is advantageous, if the thickening on the inner side of the burner supply tube is at least 0.2 times the width of the annular fluid channel. On the other side there should be a free space left from the thickening to the first fluid supply tube. Therefore, it is advantageous, if the thickening on the inner side of the burner supply tube is at most 0.7 times the width of the annular channel. It is particularly advantageous, if the height of the thickening the inner side is at least 0.3 times and/or at most 0.6 times the width of the annular channel.

BRIEF DESCRIPTION OF THE DRAWINGS

In the following figures an example of an inventive tube arrangement with an inventive burner supply tube is shown.

DETAILED DESCRIPTION OF INVENTION

Figure 1:
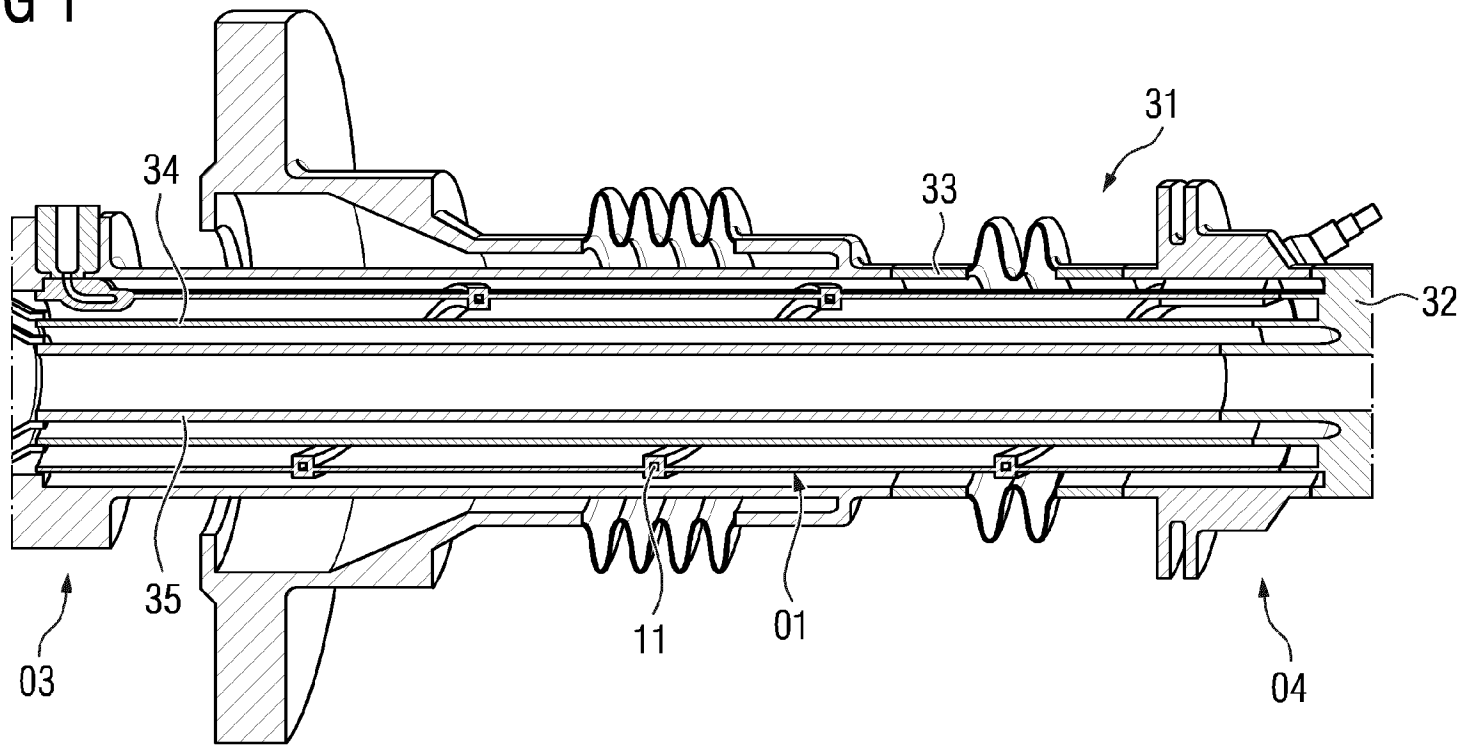
FIG. 1 shows an example of a tube arrangement in longitudinal section.

In FIG. 1 exemplary tube arrangement 31 located between a burner 32 at the downstream tube end and a terminal block at the upstream tube end 03 is shown in a longitudinal section. The tube arrangement 31 comprises at the outer side and outer protection tube 33 which 33 is firmly connected with the burner 32 on the downstream side 04 and also firmly connected to the terminal block at the upstream tube end 03. To prevent terminal stress inside the tube arrangement 31 the outer protection tube 33 comprises a bellow. Further the mounting frame is attached with further bellows in-between with the outer protection tube 33.

Next to the outer protection tube 33 the exemplary burner supply tube 01 is arranged. This 01 is also firmly connected with the burner 32 on the downstream tube end 04 and with the terminal block at the upstream tube end 03. The burner supply tube 01 comprises an integrated fuel channel 11, which has almost of the length helical shape.

Inside the burner supply tube 01 first fluid supply tube 34 is arranged. This is also firmly connected with the burner 32. To prevent terminal stress the first fluid supply tube 34 is connected with the terminal end at the upstream tube end 03 with the ability of terminal expansion. Between the burner supply tube 01 and the first fluid supply tube 34 in annular channel is defined.

In this example inside the first fluid supply tube 34 a further second fluid supply tube 35 is arranged. This leads to the possibility to guide a further medium from the upstream tube end 03 to the burner 32 at the downstream tube end 04.

Figure 2:
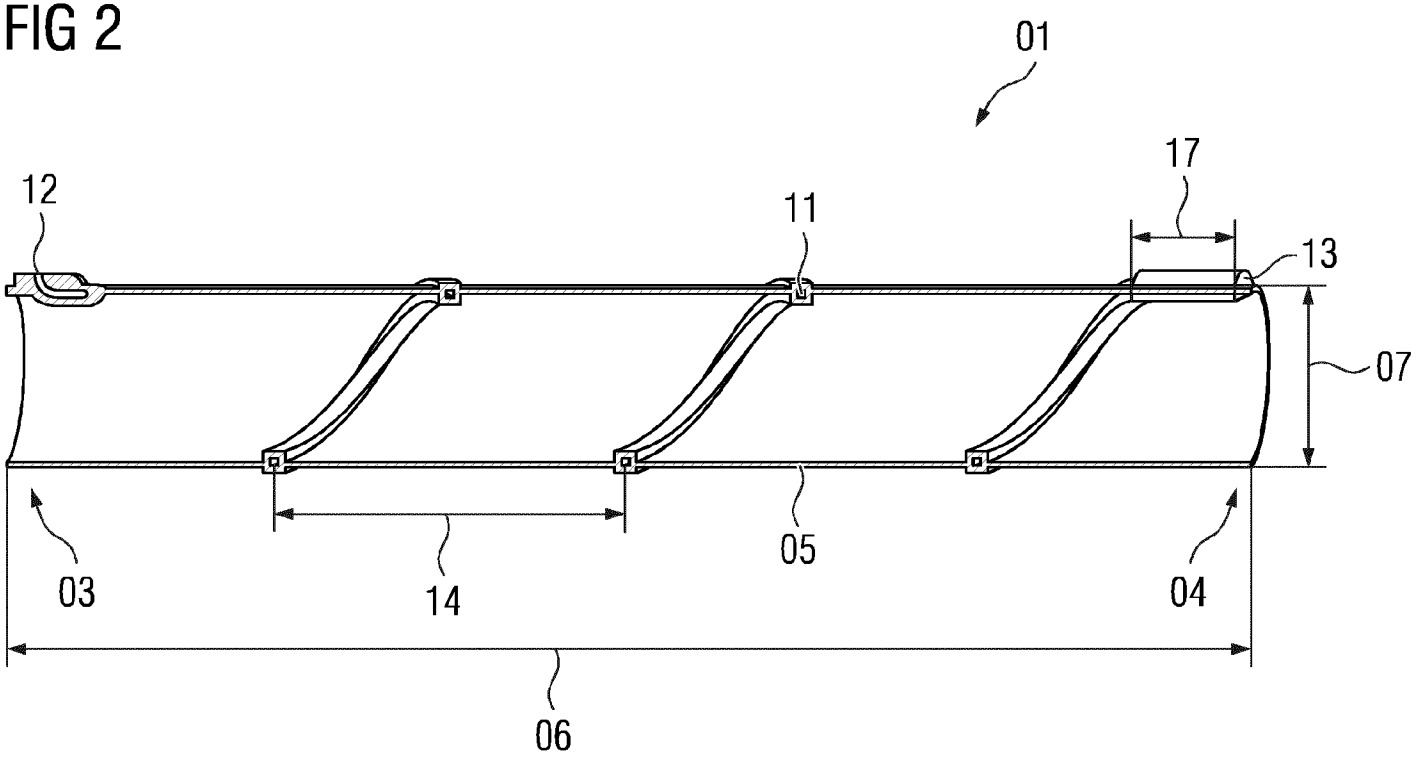
FIG. 2 shows the exemplary inventive burner supply tube.
Figure 3:
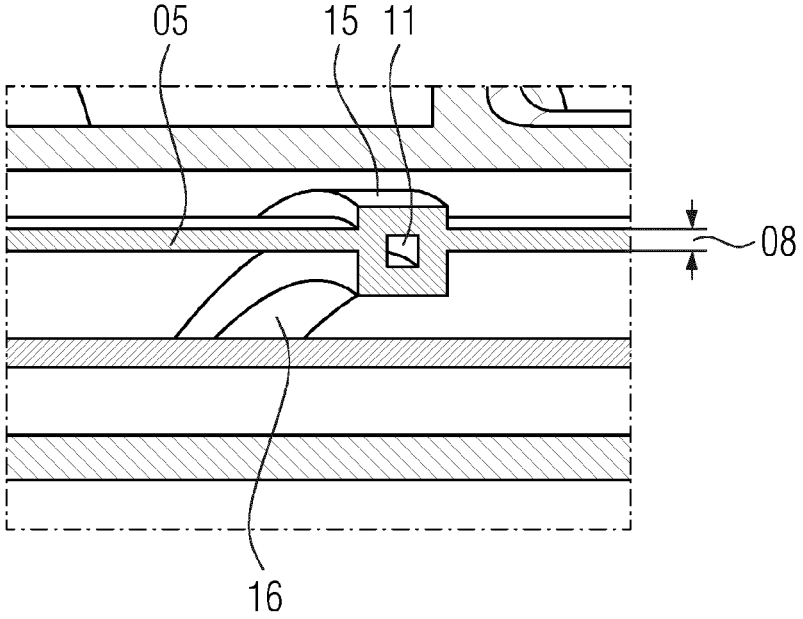
FIG. 3 shows in detail the fuel channel of the burner supply tube.

In FIG. 2 the exemplary burner supply tube 01 used in the tube arrangement 31 of FIG. 1 is shown, wherein in FIG. 3 a detail on the fuel channel is sketched. The burner supply tube 01 comprises a thin tube wall 05 with the tube length 06 and the tube diameter 07, which is the diameter on the outer side of the tube wall 05. The tube length 06 is in this example about 4 times the tube diameter 07. The tube wall 05 is quite thin compared to the size of the burner supply tube 01 and has a tube thickness 08 of about 0.05 times the tube diameter 07.

The burner supply tube 01 comprises as a key feature the fuel channel 11. This has a fuel input 12 at the upstream tube end 03 and a fuel output 13 at the downstream tube end 04 (the fuel output 13 is offset in circumferential direction and therefore not directly visible in this section). After a short distance of 17 from the fuel output 13 and analogue after a short distance from the fuel input 12 the fuel channel 11 comprises the helical shape with the gradient 14. In this example the gradient 14 of the fuel channel 11 is about 1.5 times the tube diameter 07.

The integration of the fuel channel 11 inside the burner supply tube 01 leads to the necessity to arrange thickening 15, 16 in this case on the inner side and on the outer side of the tube wall 05. The inner thickening 16 leads to a decrease of the distance the first supply tube 34. Due to the helical shape of the fuel channel 11 the inner thickening 16 does not hinder the fluid stream inside the annular fuel channel. In this example it is preferred that the fuel channel 11 is arranged with its center in a radial direction at the inner side of the tube wall 05. This leads to a smaller outer thickening 15 on the outer side of the tube wall 05 and the higher thickening 16 on the inner side of the tube wall 05.

The invention claimed is:

1. A burner arrangement having a burner and a tube arrangement, which is attached to the burner at an upstream side of the burner and which comprises:

an outer protection tube;

a first inner fluid supply tube; and a burner supply tube arranged between the outer protection tube and the first inner fluid supply tube, wherein the burner supply tube comprises:

a tube wall extending from an upstream tube end to a downstream tube end along a tube length and further having a tube diameter and a wall thickness, wherein the tube length is at least 2 times and at most 20 times the tube diameter and the wall thickness is at least 0.01 times and at most 0.2 times the tube diameter, and the tube wall comprising at least one integrated fuel channel extending from a fuel input at the upstream tube end to a fuel output at the downstream tube end, the at least one integrated fuel channel having an equivalent diameter of at least 0.3 times and at most 3 times the wall thickness, wherein the at least one integrated fuel channel is helical along a majority of the tube length, to form a helical portion of the at least one integrated fuel channel, with a gradient of at least 0.5 times and at most 5 times the tube diameter, wherein a thickening of the tube wall due to the at least one integrated fuel channel is arranged on an inner side and/or on an outer side of the tube wall.

2. The burner arrangement according to claim 1, wherein a local thickness of the thickening of the tube wall at the at least one integrated fuel channel is at most 3 times the equivalent diameter; and/or wherein a local thickness of the thickening of the tube wall at the at least one integrated fuel channel is at most 3 times the wall thickness.

3. The burner arrangement according to claim 1, wherein the tube length is at least 4 times and/or at most 10 times the tube diameter.

4. The burner arrangement according to claim 1, wherein the at least one integrated fuel channel comprises one or two integrated fuel channels.

5. The burner arrangement according to claim 1, wherein a distance from the fuel input to the helical portion and from the fuel output to the helical portion is at most 1 times the tube diameter.

6. The burner arrangement according to claim 1, wherein the fuel input and/or the fuel output are arranged on the outer side of the burner supply tube.

7. The burner arrangement according to claim 1, wherein the at least one integrated fuel channel comprises a center arranged between the middle of the tube wall and the inner side of the tube wall.

8. The burner arrangement according to claim 1, wherein the outer protection tube is fixedly attached to the burner and fixedly attached, at the upstream tube end, to a terminal block, and wherein the outer protection tube comprises bellows.

9. The burner arrangement according to claim 8, wherein the burner supply tube is fixedly attached to the burner and fixedly attached at the upstream tube end to the terminal block; and/or wherein the first inner fluid supply tube is fixedly attached to the burner while a thermal expansion is accommodated at the upstream tube end at the terminal block; and/or wherein a second inner fluid supply tube is fixedly attached to the burner while a thermal expansion is accommodated at the upstream tube end at the terminal block.

10. The burner arrangement according to claim 1, wherein an annular fluid channel is defined between the burner supply tube and the first inner fluid supply tube with a channel width between the burner supply tube and the first inner fluid supply tube, wherein the channel width is at least 0.05 times and at most 0.3 times the tube diameter.

11. The burner arrangement according to claim 1, wherein a local distance from the first inner fluid supply tube to the thickening at the at least one integrated fuel channel is at least 0.2 times and at most 0.7 times a channel width.

12. The burner arrangement according to claim 1, wherein the wall thickness is at least 0.02 times and/or at most 0.1 times the tube diameter.

13. The burner arrangement according to claim 1, wherein the equivalent diameter is at least 0.6 times and/or at most 1.5 times the wall thickness.

14. The burner arrangement according to claim 1, wherein the gradient is at least 1 times and/or at most 2.5 times the tube diameter.

15. The burner arrangement according to claim 8, wherein a distance from the fuel input to the helical portion and from the fuel output to the helical portion is at most 1 times the tube diameter.

16. The burner arrangement according to claim 8, wherein the fuel input and/or the fuel output are arranged on the outer side of the burner supply tube.

17. The burner arrangement according to claim 1, wherein the at least one integrated fuel channel comprises a center arranged between the middle of the tube wall and the inner side of the tube wall.

18. The burner arrangement according to claim 5, wherein the distance from the fuel input to the helical portion and from the fuel output to the helical portion is at most 0.5 times the tube diameter.

19. The burner arrangement according to claim 8, wherein the outer protection tube is fixedly attached to a mounting frame.

20. The burner arrangement according to claim 10, wherein the channel width is at least 0.1 times and at most 0.2 times the tube diameter.

21. The burner arrangement according to claim 11, wherein the local distance from the first inner fluid supply tube to the thickening at the at least one integrated fuel channel is at least 0.3 times and at most 0.6 times the channel width.

22. The burner arrangement according to claim 15, wherein the distance from the fuel input to the helical portion and from the fuel output to the helical portion is at most 0.5 times the tube diameter.

23. The burner arrangement according to claim 1, further comprising:

a second inner fluid supply tube.

* * * * *